US006819238B2

(12) United States Patent
Pecora et al.

(10) Patent No.: US 6,819,238 B2
(45) Date of Patent: Nov. 16, 2004

(54) METHOD AND APPARATUS FOR SIGNALING SERVICE NEEDS FOR A PUBLIC RESTROOM

(75) Inventors: Gene Pecora, Farmington, CT (US); Angelo Arcaria, Wethersfield, CT (US)

(73) Assignee: Edwards Systems Technology, Inc., Cheshire, CT (US)

( * ) Notice: Subject to any disclaimer, the term of this patent is extended or adjusted under 35 U.S.C. 154(b) by 0 days.

(21) Appl. No.: 10/303,889

(22) Filed: Nov. 26, 2002

(65) Prior Publication Data

US 2004/0100365 A1 May 27, 2004

(51) Int. Cl.[7] ..... G08B 21/00

(52) U.S. Cl. ..... 340/540; 340/326; 340/332; 340/286.07; 340/286.09; 340/286.02; 4/662; 4/664

(58) Field of Search ..... 340/540, 326, 340/332, 286.07, 286.09, 286.02; 4/662, 664

(56) References Cited

U.S. PATENT DOCUMENTS 3,810,164 A * 5/1974 Lambert ..... 340/332
3,821,707 A * 6/1974 Peters ..... 340/7.2
4,701,849 A * 10/1987 Elden ..... 705/11
5,489,887 A * 2/1996 Porras ..... 340/332
5,828,294 A * 10/1998 Shank ..... 340/326
6,164,796 A * 12/2000 La Chiusa ..... 362/122

* cited by examiner

*Primary Examiner*—Daniel J. Wu
*Assistant Examiner*—Tai T. Nguyen
(74) *Attorney, Agent, or Firm*—Baker & Hostetler LLP

(57) ABSTRACT

A restroom maintenance alert system and method for signaling when a restroom needs service includes a signaling device, an actuator located in a public restroom and configured to communicate with a signaling device to activate the signaling device, and instructions located on at least one of or on or near the actuator and directed to a restroom patron to actuate the actuator if the restroom needs service. The signaling device is located outside the public restroom. The method for signaling the restroom needs service includes providing the actuator in a restroom, instructing a restroom patron to activate the actuator if the restroom needs service, and activating a signaling device when the activator is activated.

13 Claims, 3 Drawing Sheets

METHOD AND APPARATUS FOR SIGNALING SERVICE NEEDS FOR A PUBLIC RESTROOM

FIELD OF THE INVENTION

The present invention relates generally to a method and apparatus for indicating a public restroom is in need of service. More particularly, the present invention relates to a method and apparatus for signaling to management or maintenance staff that a particular restroom is in need of service.

BACKGROUND OF THE INVENTION

Many businesses provide public restrooms for their customers or patrons. These restrooms are often provided as a courtesy or may be required by local ordinance. Many businesses view their restrooms as an opportunity to increase a company's goodwill amongst its customers and patrons. Businesses may feel providing a clean restroom in good working order will positively reflect on their business.

Restrooms, however, are prone to need maintenance for a variety of reasons. For example, supplies such as hand towels, hand soap, toilet paper and other items often dispensed in public restrooms can run out and need to be refilled. Other problems often occur in public restrooms which need maintenance such as plumbing backups and spills on the floor and the like. In addition, trash receptacles often become overflowed if not emptied often enough and create unsightly messes such as overflowing trash spilling onto the floors or counters in the restrooms.

Often when restroom patrons encounter a non-working or disorderly restroom, they are unlikely to approach a business employee about the problem in a restroom. Patrons may feel uncomfortable or embarrassed about discussing the subject of a disorderly restroom. Also, an employee may not be readily available at the time the patron is leaving the restroom. Thus, a problem in a restroom may be prolonged because it may not be reported.

Currently, in order to maintain the order and cleanliness of a restroom, the restroom facilities need to be inspected visually by an employee of the business often and on a regular basis. These constant inspections are intensive of limited human resources to businesses and are therefore expensive. In addition, at busy times, employees often are not able to take the time to inspect the restrooms, which increases the likelihood of the undesirable result of a restroom being in a disorderly or inoperative condition.

Among individual employees, inspection of restrooms may be a low priority and may be forgotten or overlooked. Thus, another problem exists in that employees may need to be reminded to regularly inspect the restrooms.

Even in situations where employees have the opportunity to inspect restrooms in a timely fashion, restroom maintenance problems are not particularly predictable and can arise at any time. For example, if an employee inspects a restroom once every two hours, it is possible that immediately after the inspection, a problem, such as a spill on the floor or a plumbing problem, can arise soon after the inspection, thus leaving the restroom in an disorderly or an inoperative condition until the next inspection.

Accordingly, it is desirable to provide a method and apparatus to alert management or maintenance staff that a restroom is in need of maintenance. It may also be desirable to provide a method and apparatus for allowing a restroom patron to alert a business employer that a restroom is in need of service in an anonymous way. If a patron can anonymously alert employees a restroom is in need of service, it may be more likely that they will alert employees a restroom needs service. Preferably, the method and apparatus may be capable of alerting management soon after a problem in the restroom is detected, not necessarily by an employee of the business, but perhaps by a patron or customer. If the problem is quickly detected, the problem can be quickly corrected and the restroom can be restored to order.

It is also desirable to provide a method and apparatus to remind business employees to inspect restrooms to ensure cleanliness and order. It may be desirable to provide an indication for a periodic check of the restroom.

SUMMARY OF THE INVENTION

It is therefore a feature and advantage of the present invention to provide a method and apparatus for alerting management or maintenance staff of a company that one of its restrooms is need of service. It is another feature and advantage of the present invention to provide a method for reminding maintenance staff or management of a business that a restroom needs to be inspected to determine if it is in need of service. The above and other features and advantages are achieved through the use of a novel method and apparatus as herein disclosed.

In accordance with one embodiment of the present invention, a restroom maintenance alert system is provided. The system comprises a signaling device and an actuator located in a public restroom and configured to communicate with the signaling device to activate the signaling device. The system further includes instructions located at least proximate to the actuator, that direct a restroom patron to actuate the actuator if the restroom needs service. The signaling device is located outside the public restroom. In some embodiments of the invention, a timing device that periodically activates the signaling device for reminding employees to inspect a restroom is provided as a part of the system.

In accordance with another embodiment of the present invention, a restroom maintenance alert system is provided. The system comprises means for signaling located outside a public restroom, and means located in the public restroom for actuating the signaling means. The system further includes means for instructing a restroom patron to actuate the actuating means if the restroom needs service, the instructing means located at least proximate the actuating means. In some embodiments of the invention, timing means for periodically activating the signaling means for reminding employees to inspect a restroom is provided as a part of the system.

In accordance with another embodiment of the present invention, a method for signaling that a restroom needs service is provided. The method comprises the steps of providing an actuator in a restroom, instructing a restroom patron to actuate the actuator if the restroom needs service, and activating a signaling device located outside the restroom when the actuator is actuated. In some embodiments of the invention, the method may also include activating the signaling device at regular intervals to remind employees to inspect restrooms.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Preferred embodiments of the present invention provide a system for alerting management or maintenance personnel that a public restroom is in need of service.

Figure 1:
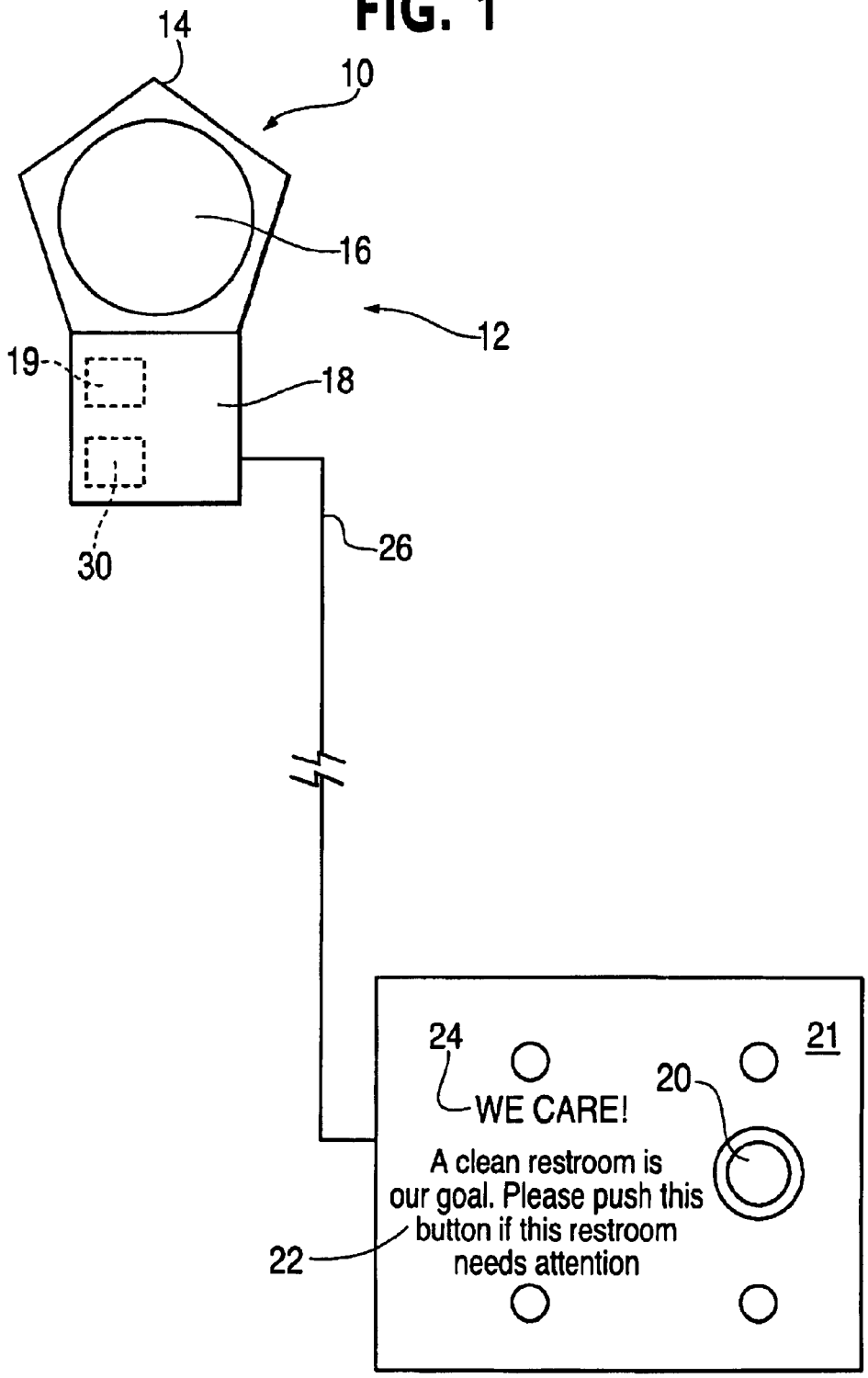
FIG. 1 is a schematic diagram of a restroom alert system according to an embodiment of the invention.

An embodiment of the present inventive apparatus is illustrated in FIG. 1, which shows a schematic of one embodiment of the present invention illustrating a system 10 for alerting maintenance or management personnel that a restroom is in need of service. The system 10 includes a signaling device 12 which may comprise a housing 14 with a light 16 attached to the housing 14. Optionally, a controller 18 may be associated with the signaling device 12 for controlling when the light 16 goes on or off. The controller 18 may be located near the signaling device 12 as shown in FIG. 1, or in some other location.

While the signaling device 12 in the embodiment shown in FIG. 1 uses a light 16 provide a to signal, other embodiments of the invention may include audible signals or any other type of signal. The light and/or audible tone may be constant and/or alternating on-off such as by flashing.

The controller 18 may include a logic printed circuit board (PCB), a microprocessor or any other type of control circuit or CPU 19 for controlling and activating the signaling device 12.

The system may also include an actuator 20 which in some embodiments may be simply a user-operated button 20 located in a restroom. The button 20 may be mounted on a mounting plate 21. The mounting plate 21 may include instructions 22 for instructing a restroom patron to actuate the actuator when the restroom is in need of service or attention. Other embodiments of the invention may simply locate the instructions 22 generally proximate the actuator 20. The instructions can be a printed decal or plate or can be a lighted sign. Alternatively, the instructions can be an audio and/or video display device.

The actuator 20 may include an apparatus for giving feed back that the actuator 20 has been actuated. Examples of feed back may include an notable noise vibration and/or a visible light on or near the actuator 20 that may come on when the actuator 20 is actuated. For example, when the actuator is a button 20, the button 20 preferably lights up similar to an elevator button when pushed in order to provide feed back that the button 20 has been actuated.

Optionally, additional text 24 may be included near the button 20 or actuator 20. The additional text may be a message management may wish to convey to a restroom patron such as "We Care" or "Help Us Keep The Restroom Clean" or any other type of message.

The actuator 20 may be connected to the signaling device 12 via a connection 26. The connection 26 may include a low voltage wire or any other type of electrical connection. One advantage of using a low voltage wire is that a reduced amount of insulation or electrical conduit may be required to properly install a low voltage system. Reduced insulation may result in smaller holes required to be drilled when installing the system which may result in lower installation costs. Other embodiments of the system 10 may use a wireless connection. The purpose of the connection 16, whether via wire or wireless, is to communicate with the controller 18 and the signaling device 12 when the actuator 20 has been actuated.

In accordance with the invention, the controller 18 may include a timer 30 such as a timing circuit or processor using an algorithim for activating the signaling device 12 at certain intervals. For example, the timer 30 may activate the controller 18 to activate the signaling device 12 to turn on every 30, 60, 90, 120, 180 minutes or some other interval depending on how often the restroom should be attended to on a regular basis. This timing function may be independent of whether or not the actuator 20 has been actuated.

In some embodiments of the invention, the signaling device 12 may give off a different signal when it is activated by the timing circuit in the controller 18 compared to when it is activated by the actuator 20. For example, the actuator 20 may cause the signaling device 12 to emit a single steady light and/or, whereas the timing device 30 within the controller 18 may cause a light or lights to flash or pulse and/or a different second.

Figure 2:
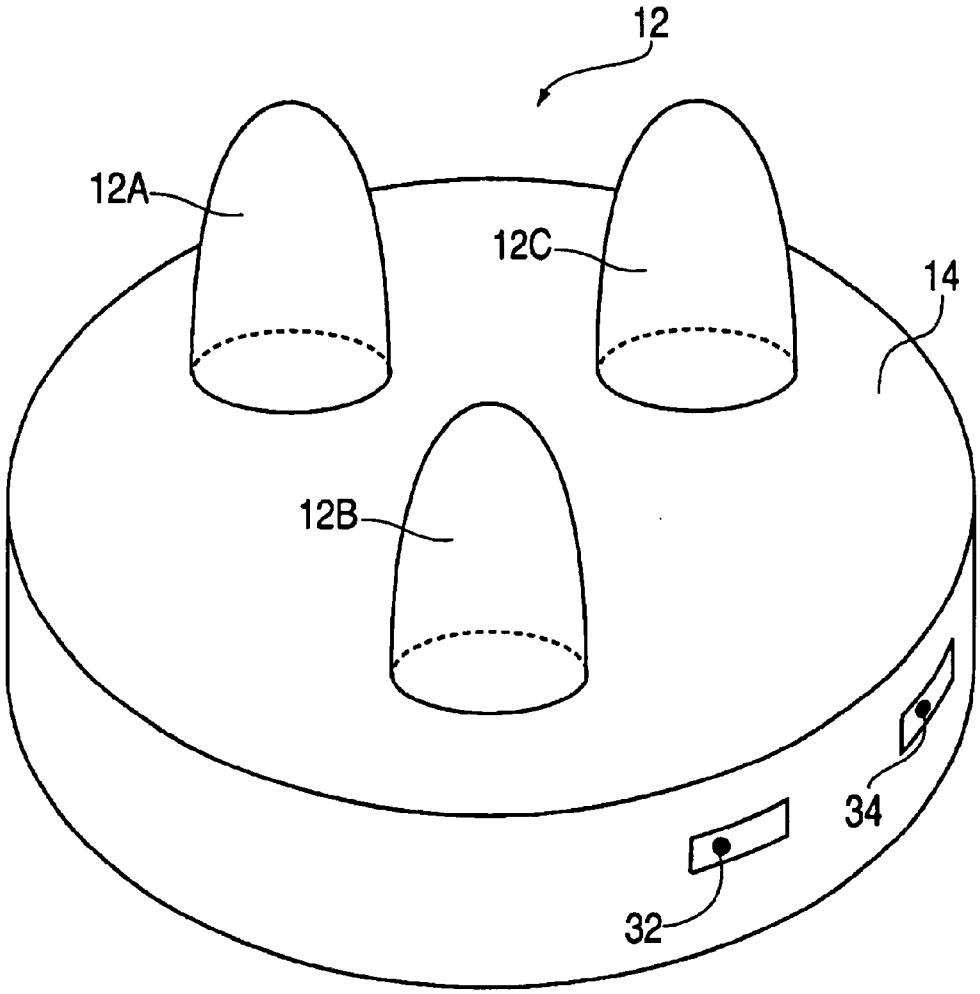
FIG. 2 is a perspective view of one embodiment of a signaling device according to the present invention.

In some embodiments of the invention, as shown in FIG. 2, a signaling device 12 may include a plurality of lights as shown as 12A, 12B, and 12C. Each light 12A, 12B, and 12C, may correspond to a particular restroom. For example, one light 12A may correspond to a men's restroom, another light 12B to a women's restroom, and a third light 12C to a handicapped restroom. When an actuator 20 associated with a particular restroom is actuated, one of the particular lights 12A, 12B, or 12C may turn on steadily or flash, thus letting an employee know that an actuator 20 has been actuated in that particular restroom. The plurality of lights can be arranged in a common housing as shown in FIG. 2.

If more than one light is used, the lights 12A, 12B, and 12C may be different colors. Each color may correspond to a particular restroom. For example, a men's restroom light 12A may be blue, the women's restroom light 12B may be red and the handicapped restroom light 12C may be amber, or any other color scheme may be adopted according to the present invention. In addition to different colors, the lights 12A, 12B, and 12C may also be associated with different indica such as letters, numbers, symbols or other indica to differentiate different restrooms. This can facilitate easy recognition of the particular restroom needing service. The light may be incandesent, florescent, LED or any other type of light known in the art.

In some embodiments of the invention equipped with the timing mechanism 30 associated with the controller 18, the signaling device 12 may make a particular signal when it has been activated with the timing mechanism 30 as opposed to when activated by the actuator 20. For example, when the signaling device 12 is activated by the timer 30 associated with the controller 18, each light 12A, 12B, 12C may flash in a rotating pattern. In this example, only one light 12A, 12B, 12C may be on for a few seconds at a time and then another light 12A, 12B, 12C will turn on for a few seconds at a time. Thus, when an employee sees the signaling device 12 flashing each light 12A, 12B, 12C in a rotating manner, the employee will know that it is the timing device 30 associated with the controller 18 that activated the signaling device 12 rather than actuator 20 being actuated within a particular restroom.

Some embodiments of the invention may include a timing switch 32 as shown in FIG. 2. The timing switch 32 may be configured to disable the timing mechanism 30 so that controller 18 does not regularly activate the signaling device 12. This function may be useful in applications where the reminding function of the system is not desired, such as for example when the business is closed to the public. In addition, the timing switch 32 may permit different intervals of time to be selected for activating the signaling device 12. For example, the timing switch 32 may be configured to permit the signaling device 12 to be activated by the timer 30 associated with the controller 18 every 30, 60, 90, 120, 180 minutes or some other interval as deemed appropriate by the operators of the system. The timing switch 32 may be, for example, a dip switch or any other type of switch known to one skilled in the art.

In some embodiments of the present invention, the signaling device 12 may be activated for only a limited amount of time when it is has been activated by the timing device 30 associated the controller 18. For example, the controller 18 may cause the signaling device 12 to flash for a period of two minutes before automatically disabling the signaling device 12.

Some embodiments of the present invention may include a reset switch 34 (shown in FIG. 2) which will allow the system to be reset after the signaling device 12 has been activated by the actuator 20. Actuating the reset switch 34 (which may be in the form of a button or switch or any other type device known in the art) the signaling device 12 will be deactivated and not activated again until either an actuator 20 has been actuated or the controller 18 has activated the signaling device 12 based on the timing circuit 30.

Figure 3:
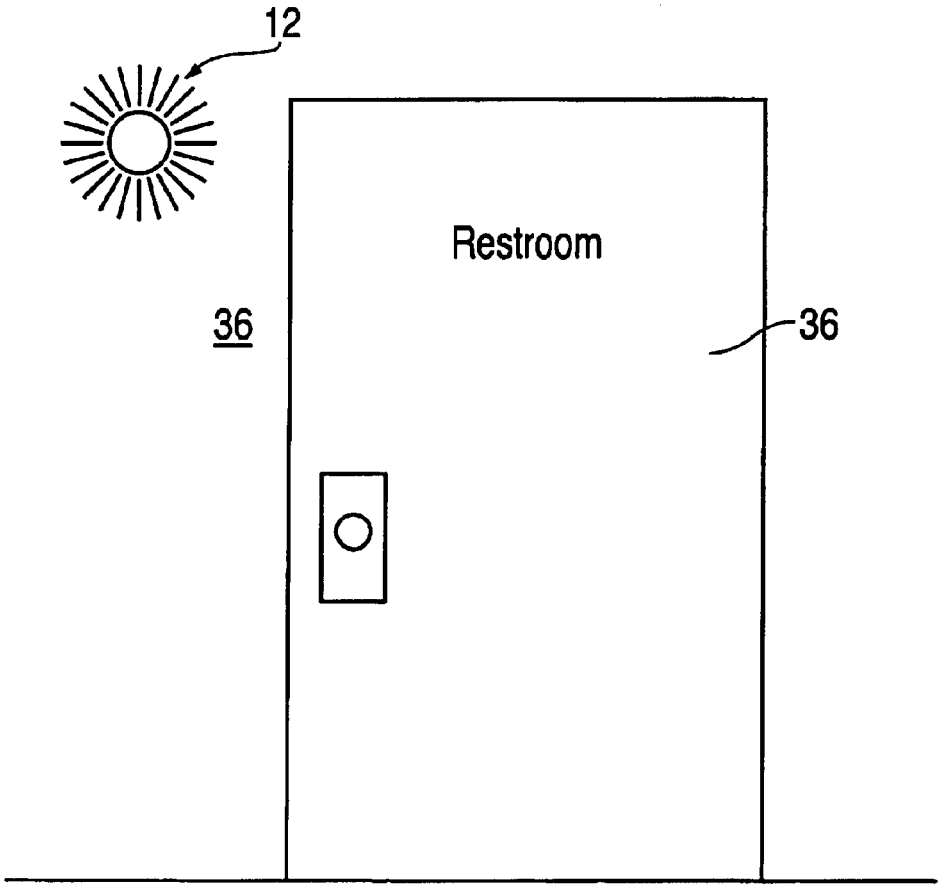
FIG. 3 is a front view of an embodiment of the present invention showing the signaling device located outside a restroom door.

The signaling device 12 may be located in a variety of areas. For example, it may be located in a manager's office, maintenance personnel's office or other any other place readily visible by employees of the business responsible for the restroom. The signaling device 12 may be located on the wall 36 outside of the restroom near a restroom door 38 as shown in FIG. 3.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A restroom maintenance alert system for a public restroom, comprising:

a first signaling device located outside the public restroom, wherein the first signaling device emits a different signal when activated by the actuator than when activated by the timer;

an actuator located in the public restroom and configured to communicate with the first signaling device to activate the signaling device to emit a signal;

instructions located at least proximate to the actuator that direct a restroom patron to actuate the actuator if the restroom needs service; and a timer operatively connected to the first signaling device, wherein the timer is configured to activate the first signaling device at preset intervals to emit a signal, wherein the system is used with more than one restroom and the first signaling device includes a plurality of lights, each light corresponding to a respective restroom, and wherein when the first signaling device is activated by the timer, the lights emit signals in an alternating pattern, and when an actuator located in a specific restroom is activated, the light corresponding to that respective restroom emits a signal different than the alternating pattern.

2. The alert system of claim 1, wherein the actuator is configured to communicate with the first signaling device by at least one of: an electrical connection, a low voltage wire, and a wireless transmission.

3. The alert system of claim 1, further comprising a second signaling device located on or near the actuator and configured to emit a signal when the actuator has been actuated.

4. The alert system of claim 1, wherein the first signaling device is located in at least one of: directly outside the restroom, in a managers office, and in a maintenance personnel office.

5. The alert system of claim 1, wherein the system is used with first and second restrooms and the first signaling device includes at least two lights and wherein at least one of the lights turns on when an actuator located in the first restroom is actuated and at least a different one of the lights turns on when an actuator located in the second restroom is actuated.

6. A restroom maintenance alert system for a public restroom, comprising:

first means for signaling located outside the public restroom;

means for actuating the first signaling means, the actuating means being located in a public restroom; and means for instructing a restroom patron to actuate the actuating means if the restroom needs service, the instruction means located at least proximate the actuating means, wherein the first signaling means emits a different signal when activated by the means than when activated by the timing means; and means for timing operatively connected to the first signaling means, wherein the timing means is configured to activate the signaling means at preset intervals to emit a signal, wherein the system is used with more than one restroom and the first signaling means includes a plurality of lights, each light corresponding to a specific restroom, and when the first signaling means is activated by the timing means, the lights flash in an alternating manner, and when an actuating means located in a specific bathroom is activated, the light corresponding to a specific restroom emits a different signal than the alternating pattern turns on.

7. The alert system of claim 6, wherein the actuating means is configured to communicate with the first signaling means by at least one of an electrical connection, a low voltage wire, and a wireless transmission.

8. The alert system of claim 6, further comprising a second means for signaling located at least proximate the actuating means and configured to emit a signal when the actuating means has been actuated.

9. The alert system of claim 6, wherein the first signaling means is located in at least one of: directly outside the restroom, in a manager's office, and in a maintenance personnel office.

10. The alert system of claim 6, wherein the system is used with first and second restrooms and the first signaling means includes at least two lights and wherein at least one of the lights turns on when an actuating means located in the first restroom is actuated and at least a different one of the lights turns on when an actuating means located in the second restroom is actuated.

11. A method for signaling a restroom needs service comprising:

providing an actuator in a restroom;

instructing a restroom patron to actuate the actuator if the restroom needs service;

activating a signaling device located outside of the restroom when the actuator is actuated;

activating the signaling device on a timed interval;

emitting a first signal from the signaling device when the signaling device is activated by the timed interval and a second signal different from the first signal when the signaling device is activated by the actuator.

12. The method of claim 11, further comprising locating the signaling device in at least one of: a managers office, a maintenance personnel office, and directly outside the restroom.

13. The method of claim 11, wherein activating the signaling device includes lighting at least one light in the signaling device.

* * * * *